US006680026B1

(12) United States Patent
Denkewicz, Jr. et al.

(10) Patent No.: US 6,680,026 B1
(45) Date of Patent: Jan. 20, 2004

(54) FLUID FLOW DIVERTERS AND DIVERSION METHODS AND WATER PURIFICATION EQUIPMENT INCLUDING SUCH DIVERTERS

(75) Inventors: Raymond P. Denkewicz, Jr., Warwick, RI (US); Alvin Costa, Tiverton, RI (US); Daniel J. Nelsen, Providence, RI (US); Michael C. Pereira, Lincoln, RI (US); Justin W. Sirotin, Providence, RI (US); Michael Vieira, Fall River, MA (US); Aidan J. Petrie, Providence, RI (US)

(73) Assignee: Zodiac Pool Care, Inc., Pompano Beach, FL (US)

( * ) Notice: Subject to any disclaimer, the term of this patent is extended or adjusted under 35 U.S.C. 154(b) by 0 days.

(21) Appl. No.: 09/305,735

(22) Filed: May 5, 1999

(51) Int. Cl.[7] ..... C02F 1/50

(52) U.S. Cl. ..... 422/28; 422/266; 422/282; 422/283; 137/268; 137/599.15

(58) Field of Search ..... 422/261, 267, 422/271, 28, 266, 286, 274, 278, 283, 282; 210/289; 137/268, 615, 625.48, 625.6, 599.15, 192, 205, 206, 282

(56) References Cited

U.S. PATENT DOCUMENTS

| | | | | | |
|---|---|---|---|---|---|
| 2,113,203 | A | * | 5/1938 | Straubel | |
| 2,340,205 | A | * | 1/1944 | Pinkerton | 422/282 |
| 2,604,446 | A | * | 7/1952 | Palmer | 422/112 |
| 2,752,228 | A | | 6/1956 | Gould | 73/422 |
| 3,430,917 | A | | 3/1969 | Pellett | 251/149.4 |
| 3,630,363 | A | * | 12/1971 | Nash | 137/625.48 |
| 3,649,055 | A | | 3/1972 | Nilsen | 285/197 |
| 3,756,234 | A | | 9/1973 | Kopp | 128/214 |
| 4,119,242 | A | * | 10/1978 | Jesty | 221/211 |
| 4,215,880 | A | | 8/1980 | Trittipoe | 285/61 |
| 4,258,941 | A | | 3/1981 | Sands | 285/197 |
| 4,640,372 | A | * | 2/1987 | Davis | 175/208 |
| 5,090,742 | A | | 2/1992 | Cohen et al. | 285/114 |
| 5,120,303 | A | | 6/1992 | Hombrouckx | 604/4 |
| 5,240,294 | A | | 8/1993 | Corcoran | 285/373 |
| 5,300,224 | A | * | 4/1994 | Farley | 210/266 |
| 5,352,369 | A | | 10/1994 | Heinig, Jr. | 210/760 |
| 5,358,007 | A | * | 10/1994 | Carlberg | 137/615 |
| 5,368,337 | A | | 11/1994 | Torres | 285/114 |
| 5,660,802 | A | * | 8/1997 | Archer et al. | 422/261 |
| 5,766,456 | A | | 6/1998 | Denkewicz, Jr. et al. | 210/167 |
| 5,772,896 | A | | 6/1998 | Denkewicz, Jr. et al. | 210/754 |
| 5,779,913 | A | | 7/1998 | Denkewicz, Jr. et al. | 210/752 |
| 5,810,999 | A | * | 9/1998 | Bachand et al. | 210/206 |
| 5,855,777 | A | * | 1/1999 | Bachand et al. | 210/205 |

FOREIGN PATENT DOCUMENTS

| | | |
|---|---|---|
| EP | 0498324 | 8/1992 |
| EP | 0583707 | 2/1994 |
| EP | 0645573 | 3/1995 |
| EP | 0283192 | 9/1998 |

OTHER PUBLICATIONS

Merriam–Webster's Collegiate Dictionary, Tenth Edition, Merriam–Webster, Incorporated Springfield, Massachusetts, USA, 1999, p. 1267.*

* cited by examiner

*Primary Examiner*—Elizabeth McKane
(74) *Attorney, Agent, or Firm*—Dean W. Russell; Kilpatrick Stockton LLP

(57) ABSTRACT

"Plug-in" fluid flow diverters are disclosed. Additionally disclosed is water purification equipment adapted to communicate with the diverters. Such equipment is especially (although not solely) useful in connection with circulating streams of water present in systems associated with swimming pools, hot tubs, and spas, as the circulating nature of the water permits more of its volume ultimately to be diverted into the equipment for purification. The diverters, furthermore, may have entrances oriented to receive fluid travelling in only one direction through a conduit and be keyed to one or more components of the equipment for purposes of identification, inventory control, or otherwise.

14 Claims, 6 Drawing Sheets

FLUID FLOW DIVERTERS AND DIVERSION METHODS AND WATER PURIFICATION EQUIPMENT INCLUDING SUCH DIVERTERS

FIELD OF THE INVENTION

This invention relates to diverters of flowing fluid and methods of installing and using such diverters and more particularly to water purification equipment including such diverters optionally keyed internally to components thereof.

BACKGROUND OF THE INVENTION

U.S. Pat. No. 5,660,802 to Archer, et al. discloses water purifiers having bodies defining multiple flow paths. As described at column 4, lines 9–21 of the Archer, et al. patent, water flowing into a body along a first path encounters a constricted region of the path > that has a smaller cross sectional area than the cross sectional area of the inlet port. This constricted region causes a pressure increase in the water flowing along the first path, and thereby ensures that water will also flow along the second path. As necessary to ensure proper flow through the water purifier, the cross sectional area of the constricted region can be adjusted by removing a flow regulator that is positioned in the constricted region and further reduces the cross-sectional area of the constricted region.

(Numeral Deleted.)

U.S. Pat. No. 5,810,999 to Bachand, et al. discusses embodiments of another water purifier incorporating a fluid deflector. Extending downward from a support plate contained within the device, the deflector is positioned "such that at least a portion of a flow of water entering" through an inlet strikes it "and is directed upward" into a cavity thereabove. The remainder of the flowing water passes into a strainer basket before exiting the device. See Bachand ('999), et al., col. 3, 11. 25–32.

Recently-issued U.S. Pat. No. 5,855,777 to Bachand, et al. details additional water purification devices. Included in embodiments of these multi-chamber devices are a canister and diffuser, such that:

> Water entering the canister inlet flows along an inlet tube through the center of the canister. Near the upper end of [the] tube, some of the water flows into [a] lower chamber through side ports, while the remainder continues up [the] tube to enter [an] upper chamber through a diffuser. Water leaves [the] lower chamber through openings positioned within the side wall of [the] canister, flowing out into [a] cavity. Water leaves [the] upper chamber through openings in the top of the canister, also flowing out into [the] cavity. In this manner two separate, effectively parallel flow paths are defined from [the] inlet tube to [the] cavity, one through each of [the chambers].

See Bachand ('777), et al., col. 3, 11. 15–26 (numerals omitted).

Each of the devices described above is designed typically to be plumbed in-line and connect to water pipes or hoses (generically referred to herein as "conduits"). As a consequence, inlets and outlets of the devices are usually threaded (or fitted with unions suitable for gluing), permitting them to receive and retain corresponding ends of conduits. The respective flow regulators, deflectors, and diffusers, furthermore, are positioned within the bodies, devices, or canisters of the water purification equipment.

SUMMARY OF THE INVENTION

The present invention, by contrast, provides fluid flow diverters designed to penetrate, or fill, openings intermediate remote ends of conduits. They thus supply "plug-in" styles of diverters which need not be connected to ends of conduits and plumbed in-line. Embodiments of the invention contemplate diverting flowing fluid to purification equipment formed about or otherwise connected to such diverters, permitting diverted water to be purified before rejoining the flow. The purification equipment is especially (although not solely) useful in connection with circulating streams of water present in systems associated with swimming pools, hot tubs, and spas, as the circulating nature of the water permits more of its volume ultimately to be diverted into the equipment for purification.

Diverters of the present invention optionally may be "direction-specific," in that their entrances may be oriented so as to receive fluid travelling in only one direction longitudinally through a conduit. In such cases proper positioning of the diverters relative to the conduit is significant unless reversible flow can occur through it. If desired, equipment associated with the diverters can provide instruction as to its proper placement for a particular direction of flow through such a conduit.

Additionally, diverters used in connection with the present invention can communicate with central tubes in (or other desired components of) associated equipment. Connections with such tubes may occur in myriad ways, with particular diverters being keyed to particular styles of central tubes if desired. Such keying may be useful, for example, in controlling inventories of spare parts or for purposes of identification should a component fail in use.

Water purification equipment incorporating a flow diverter of the present invention may also include a saddle (or other) clamp designed to attach to a cylindrical (or other) conduit and receive the flow diverter. A gasket or other item or mechanism positioned adjacent the clamp may be used to provide a seal inhibiting (or precluding) fluid from flowing out of the conduit around (rather than through) the diverter. Additionally attached to the clamp may be a shell or housing, which in some embodiments may be topped by a removable dome. In these embodiments of the equipment, removing the dome provides access to the interior of the housing.

Placed within the housing of at least some of these embodiments is a (typically removable) cartridge or other container of water purification media. Such media may comprise mineral-based pellets or other objects of silver-, zinc-, or copper-containing material as described in any of U.S. Pat. Nos. 5,352,369, 5,766,456, 5,772,896, and 5,779,913, the disclosures of which are incorporated herein in their entireties by this reference. Other suitable non-mineral-based purification media may be used instead, however, as the invention is not limited to media containing one or more of the elements or minerals mentioned in the preceding sentence. Chlorine or other chemicals which may be dissolved or contacted by the water being diverted are among suitable alternatives.

Circumscribed by the exterior of the container may be a central tube, which as noted above communicates with the diverter to permit fluid flow therethrough. A portion of the tube may in some cases extend beyond the end or (nominal) top of the container and include one or more openings. If the top of the container likewise contains openings, the pressurized fluid travelling through the diverter may exit the tube through the one or more openings and reenter the container through the openings in its top. Moreover, if the dome is not opaque, this pressurized fluid may be visible therethrough as it exits the tube and reenters the container, providing a visual display of the operation of the equipment. Alternatively or additionally, the tube may contain openings in the sides of the portion included within the container through which fluid may exit.

Once having exited the central tube and entered the container, the flowing fluid diverted from the conduit contacts the purification media. This contact acts to purify the diverted fluid and, in some situations, to abrade, dissolve, or otherwise cause minute quantities of the media to join the fluid stream. Post contact the purified fluid exits the cartridge, rejoining the fluid in the conduit either slightly downstream or slightly upstream of the diverter (or both). Those skilled in the art will, however, recognize that variations and relative placements of components may occur or change, respectively, and yet remain consistent with the present invention.

It is therefore an object of the present invention to provide fluid flow diverters and methods of installing and using the same.

It is also an object of the present invention to provide such diverters which penetrate openings in the walls of conduits intermediate their ends.

It is another object of the present invention to provide "plug-in" fluid flow diverters which function to divert fluid to purification equipment.

It is a further object of the present invention to provide flow diverters whose entrances may be oriented to receive fluid travelling in only one direction through a conduit.

It is an additional object of the present invention to provide fluid flow diverters which engage and can be keyed to other objects such as central tubes of purification equipment.

It is yet another object of the present invention to provide water purification equipment in which a housing optionally may have a removable dome permitting access to the interior of the equipment.

It is also an object of the present invention to provide water purification equipment containing purification media which may, but need not necessarily, be mineral-based.

It is an additional object of the present invention to provide water purification equipment in which diverted water travels through at least a portion of the central tube before contacting the purification media.

Other objects, features, and advantages of the present invention will become apparent with reference to the remainder of the text and the drawings of this application.

DETAILED DESCRIPTION

Figure 1:
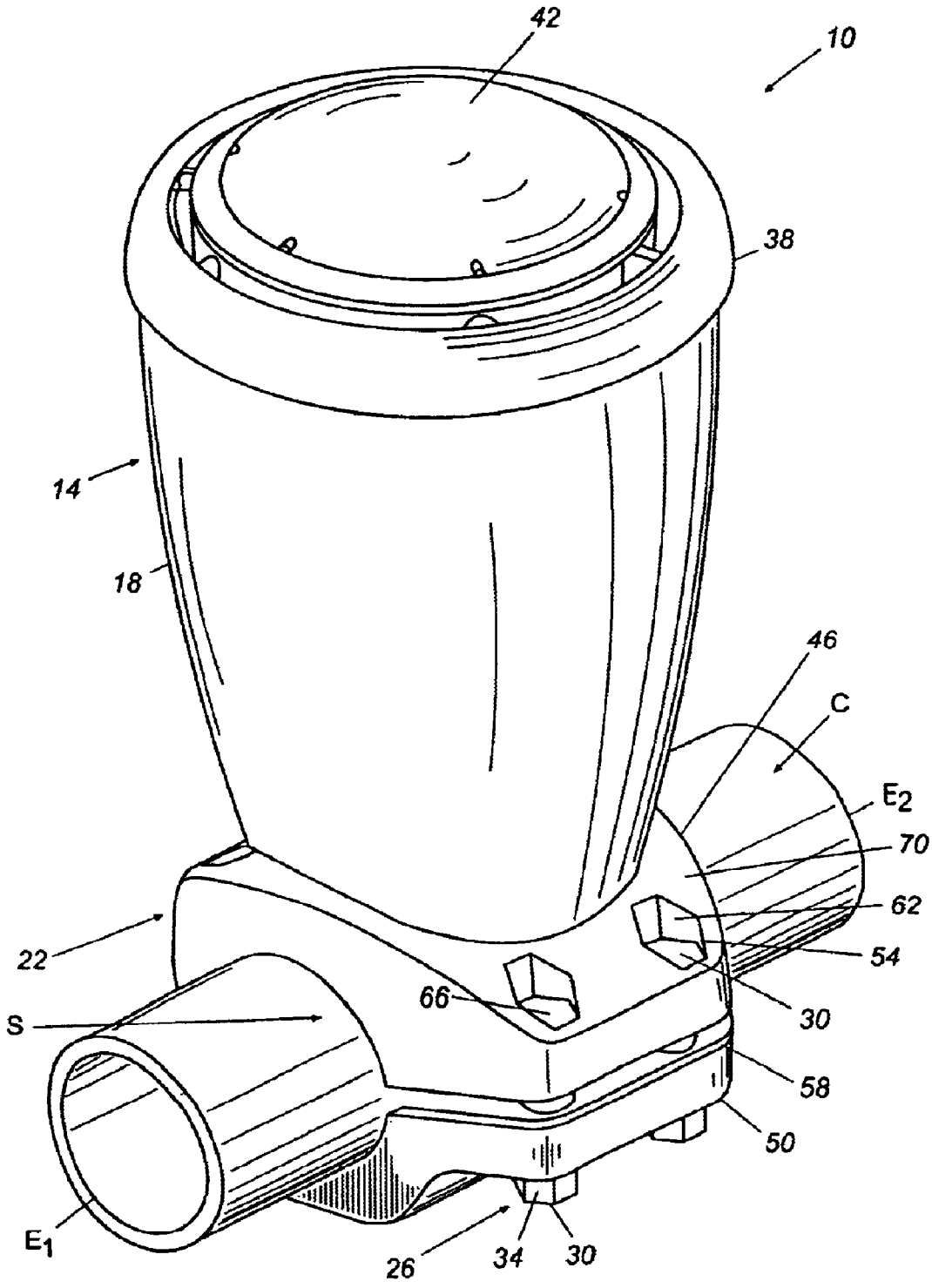
FIG. 1 is a perspective view of water purification equipment of the present invention.

FIG. 1 illustrates exemplary equipment 10 consistent with the present invention. Equipment 10 includes housing 14, whose exterior 18 is shown in FIG. 1, and clamp 22. Also included as part of equipment 10 are fasteners 26, which in the embodiment of FIG. 1 are exemplified by bolts 30 and nuts 34. Illustrated as well in FIG. 1 are cover ring 38 and dome 42, which may comprise components of either housing 14 or cartridge 44. If a component of the latter, cover ring 38 may be fitted onto housing 14 to assist in retaining it in position.

Equipment 10 is adapted for connection to a conduit C. As shown in FIG. 1, such connection may occur at a walled section S of conduit C intermediate ends $E_1$ and $E_2$. Equipment 10 thus may be connected to conduit C without being plumbed in-line. Furthermore, because housing 14 need not be upright in use, it may be oriented above, below, or to the side of conduit C as appropriate or desired. Such flexibility of orientation of housing 14 relative to conduit C enhances the ability of equipment 10 to optimize utilization of space surrounding the conduit C.

Clamp 22 and fasteners 26 may be used to connect housing 14 to conduit C. FIG. 1 details clamp 22 as having two saddle-shaped sections, nominally denoted "upper" section 46 and "lower" section 50. As noted in the preceding paragraph, however, equipment 10 may be oriented such that, in some cases, upper section 46 may be below lower section 50 relative to a floor or the ground.

Each of upper section 46 and lower section 50 may define one or more pairs of openings 54 and 58, respectively, the openings of each of which pairs may be aligned so as jointly to receive a bolt 30 or other fastening means. If desired, at least a portion 62 of each opening 54 may be of size greater than the head 66 of bolt 30 received therein. This effectively countersinks head 66 below surface 70 of upper section 46 while portion 62 provides a guide facilitating insertion of bolt 30 into opening 54.

Figure 2:
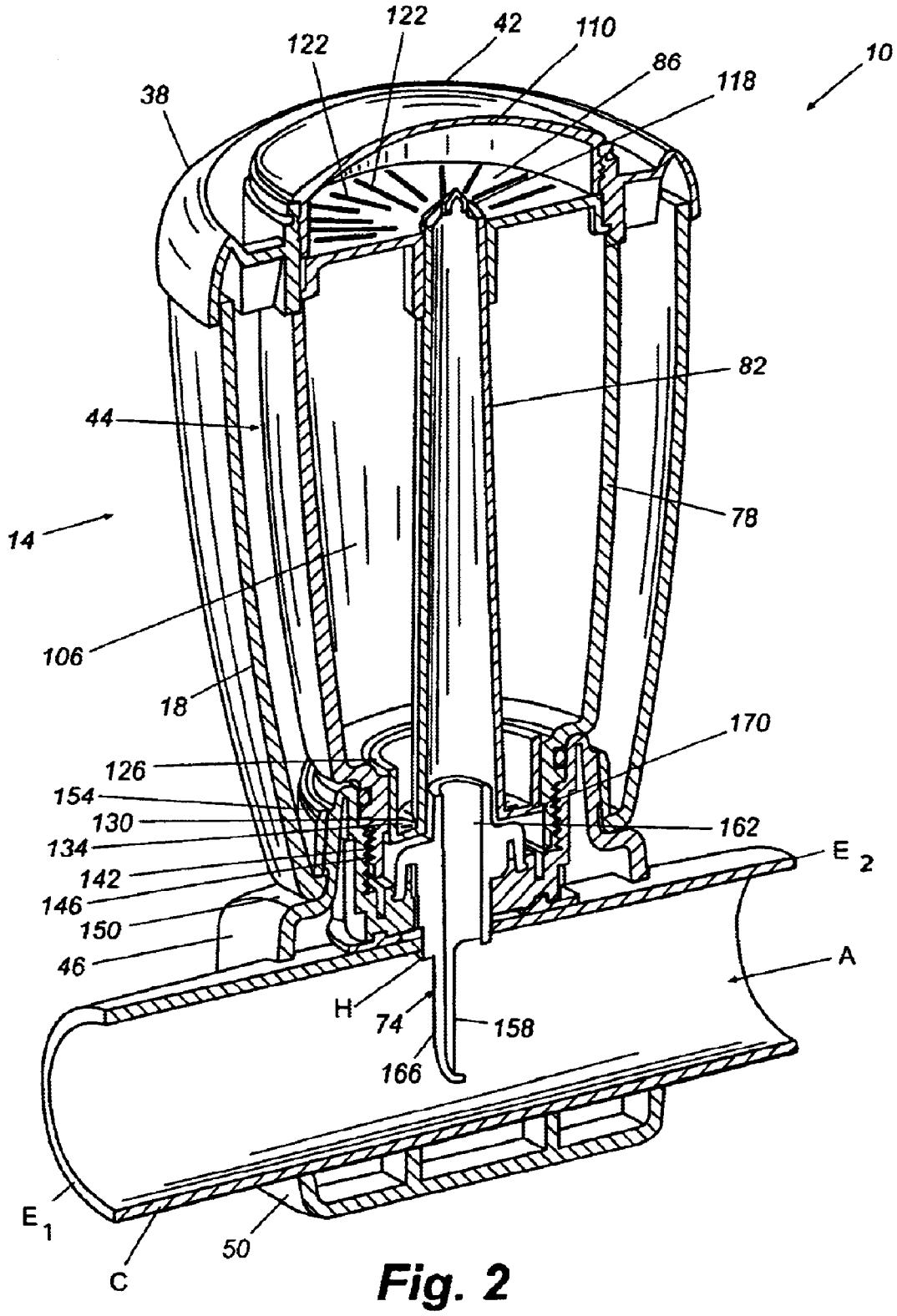
FIG. 2 is a cross-sectional view of the equipment of FIG. 1.
Figure 3:
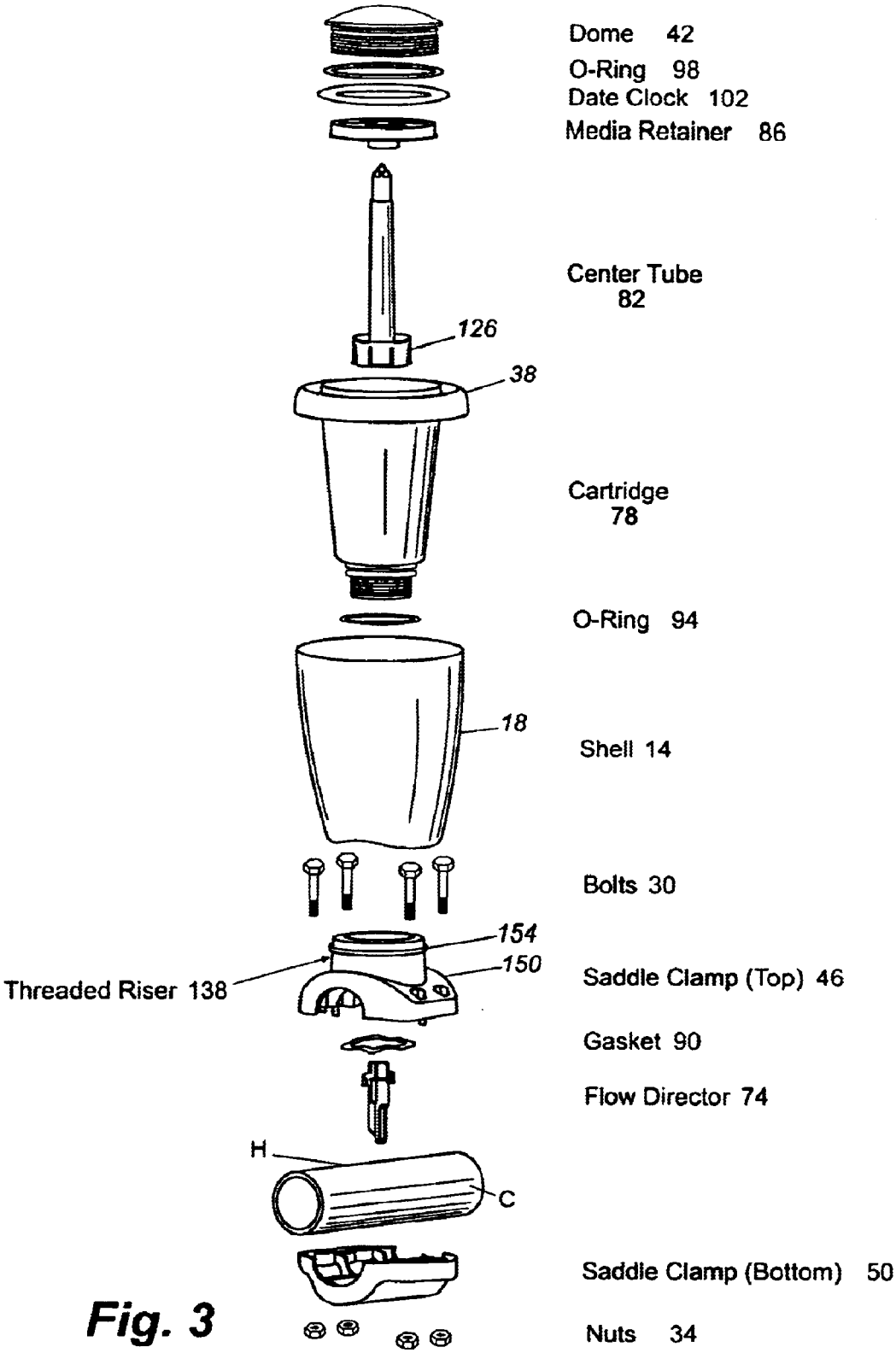
FIG. 3 is an exploded view of some of the components of the equipment of FIG. 1.

FIGS. 2–3 detail additional components which may be present in exemplary equipment 10. Shown therein are diverter 74, container 78 (to which cover ring 38 may be connected), center tube 82, and media retainer 86, the latter component functioning as the nominal "top" of container 78 within cartridge 44. Also illustrated particularly in FIG. 3 are various seals such as gasket 90 and O-rings 94 and 98, which may be used to inhibit fluid leakage at certain junctions within equipment 10. Those skilled in the art will, of course, recognize that more or fewer such seals may be employed as appropriate or desired. Optionally included as well as part of equipment 10 may be sticker or ring 102, which if present may convey information to a consumer as to the desired month or date for replacing purification media 106, which is shown schematically as being present within container 78. If container 78 is threaded or otherwise adapted to receive dome 42, these components may form the majority of a removable cartridge 44.

To install equipment 10 in the manner of FIGS. 1–3, a hole H must be formed or created in conduit C. Such hole H admits fluid flow from conduit C into housing 14, permitting the fluid so flowing to contact media 106 before returning to the conduit C. Fluid communication between conduit C and housing 14 is provided at least in part by diverter 74, which as shown in FIG. 2 extends through (i.e. "plugs into") hole H into conduit C. Diverter 74 in turn communicates with center tube 82, which provides a flow path through container 78 to a region 110 of the interior of cartridge 44 between dome 42 and retainer 86.

One or more openings 118 of center tube 82 present in region 110 allow fluid to escape from the tube 82 into the region 110, from which it can reenter container 78 via one or more openings 122 of media retainer 86. These actions can assist in distributing the flowing fluid more uniformly within container 78, facilitating more uniform contact of the fluid with purification media 106. If dome 42 is not opaque, furthermore, fluid escaping into region 110 may be visible from outside the dome 42, providing consumers with a visual indication whether or not equipment 10 is operating. Alternatively or additionally, center tube 82 may open directly into container 78 to expose fluid to purification media 106 contained therein.

In an embodiment of equipment 10 consistent with FIGS. 2–3, a portion of center tube 82 opposite openings 118 has integrally formed therewith cup 126, whose nominal "bottom" 130 contains one or more openings 134. Such openings 134 permit fluid to exit container 78, after having contacted media 106, for return to conduit C via hole H to rejoin the fluid passing through the conduit C.

Passage of fluid between openings 134 and hole H is governed by at least partially hollow riser 138 of upper section 46 of clamp 22. As configured in FIGS. 2–3, riser 138 has threads 142 which engage corresponding threads 146 of container 78, thus connecting upper section 46 to container 78. Additionally included as parts of riser 138 are external shoulders 150 and outer circumferential lip 154, between which housing 14 may be fitted (i.e. snapped into place). Diverter 74, by contrast, may be fitted into the interior of riser 138 and retained therein, thus fixing its position relative to each of riser 138, housing 14, and container 78. Center tube 82, finally, may be connected to diverter 74 as discussed in connection with FIGS. 4–6 or otherwise as appropriate. These connections provide a flow path in which fluid passes through each of openings 134, a hollow portion of riser 138, and hole H to return to conduit C.

Illustrated in FIG. 2 is an exemplary diverter 74 of the present invention. Diverter 74 may include a scooped portion, or trough 158, extending into conduit C. Trough 158 communicates with channel 162 of diverter 74, in turn permitting communication with center tube 82.

Because trough 158 faces end $E_2$ of conduit C, it is adapted to receive fluid travelling only from end $E_2$ to $E_1$, in the direction of arrow A. In this sense diverter 74 is "direction specific": Were fluid to flow through conduit C in the direction opposite arrow A, such fluid would contact base 166 of trough 158 and not be admitted into channel 162. A non-direction specific diverter 74 alternatively could have dual troughs 158, one opening in each direction of fluid flow longitudinally within conduit C, or otherwise accept fluid flowing in either direction with the conduit C.

However, in embodiments of the invention in which diverter 74 is direction specific, its proper orientation relative to the direction of fluid flow within conduit C is significant. Accordingly, diverter 74 can be designed, if desired, so as to fit within riser 138 in only one orientation. In these circumstances upper section 46 could be provided with textual or visual instruction (or both) to aid consumers in orienting clamp 22 relative to the direction of flow within conduit C.

Figure 4:
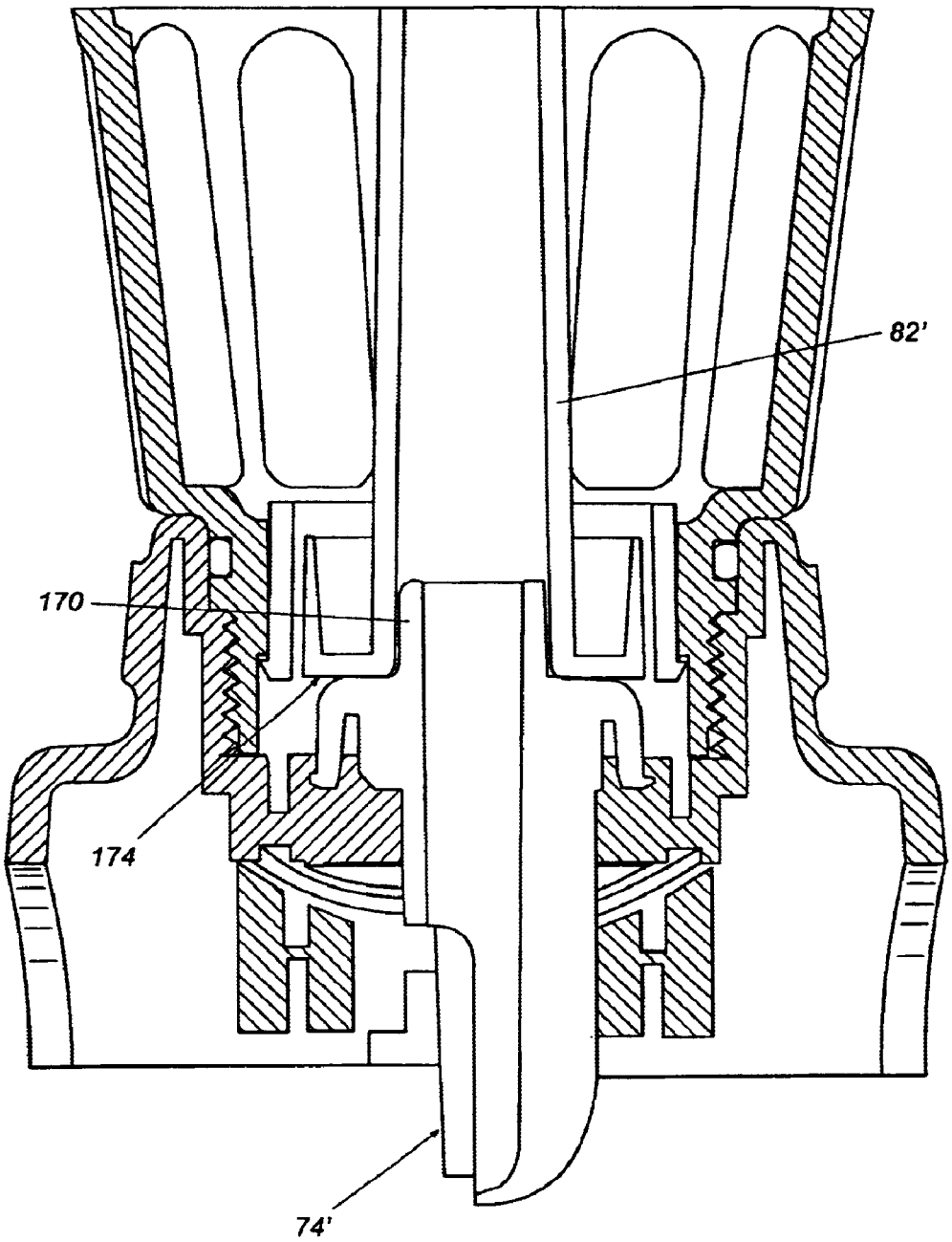
FIGS. 4–6 are cross-sectional views of aspects of alternative mechanisms for mating diverters and center tubes of the equipment of FIG. 1.
Figure 5:
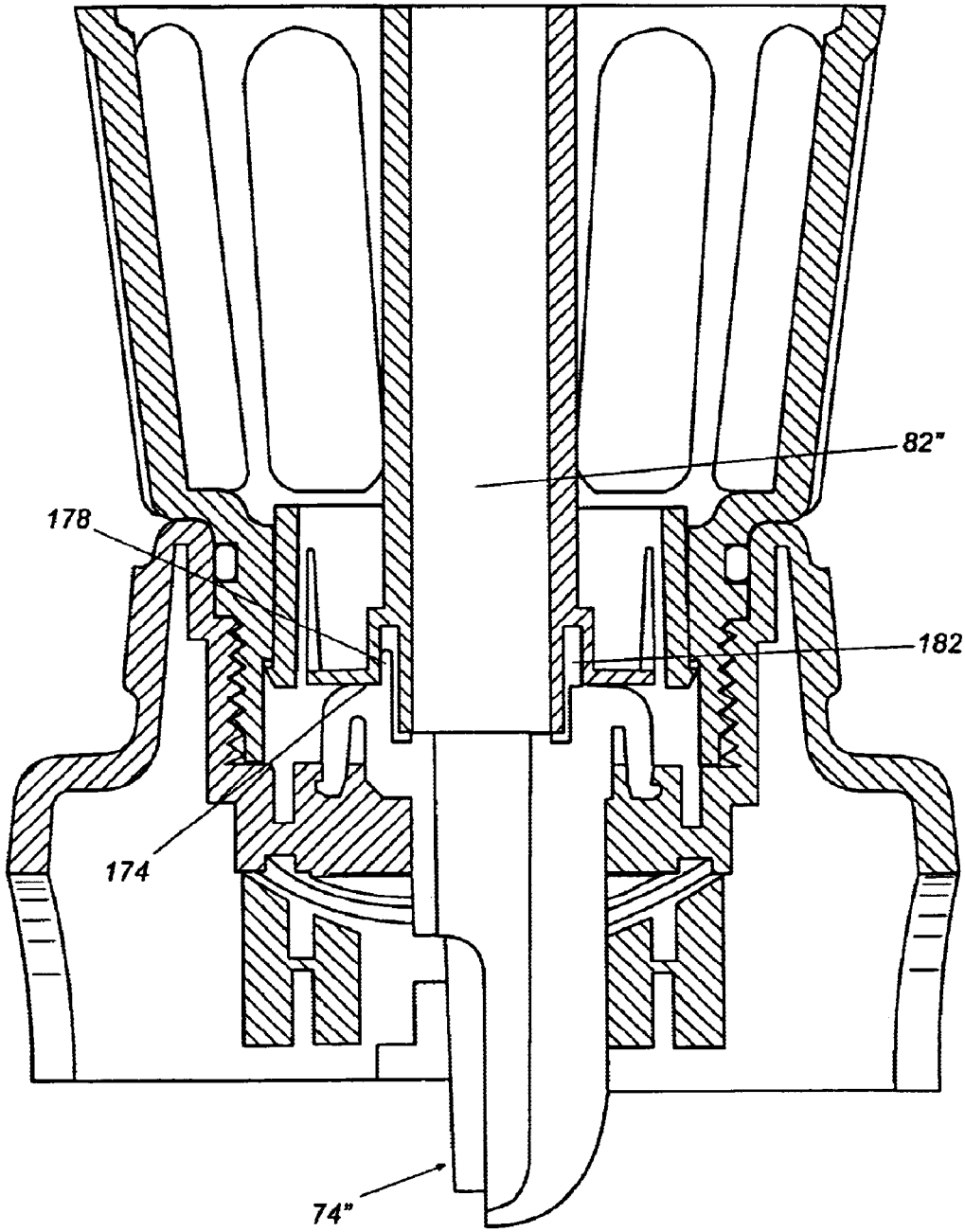
Figure 6:
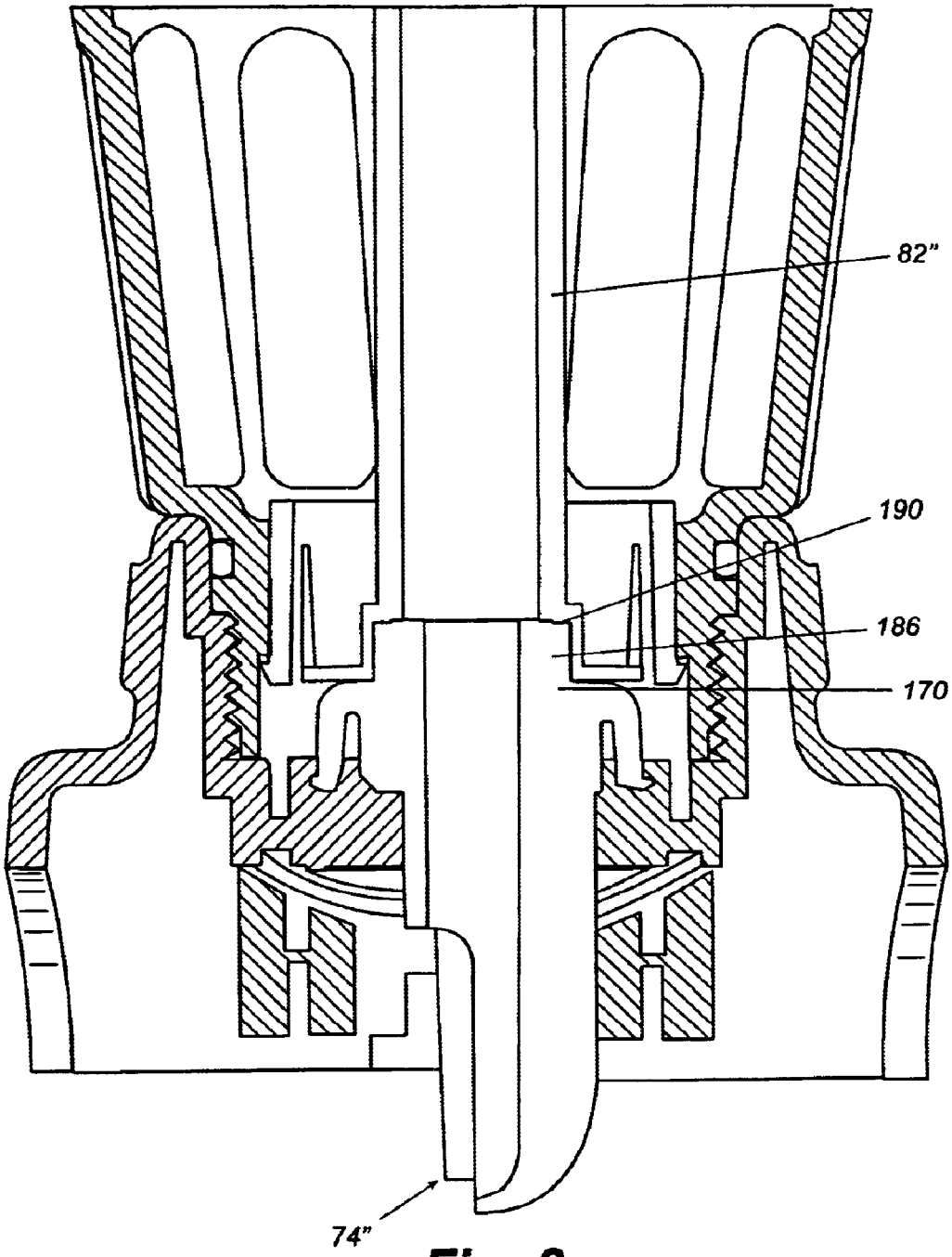

FIGS. 4–6 illustrate alternative diverters 74 of the present invention and their relationships with various alternative center tubes 82. In FIG. 4, for example, diverter 74' includes wall 170, of circular cross-section, which continues channel 162 beyond shoulders 174. Wall 170 is of diameter such that it may be fitted into center tube 82' adjacent cup 126 and retained therein by friction or interference.

FIG. 5, by contrast, illustrates a diverter 74" in which channel 162 terminates before reaching shoulders 174. In this embodiment of equipment 10, diverter 74" includes a semicircular collar 178. This collar 178 is designed to be received by a corresponding recess 182 at the junction of center tube 82" and cup 126.

As should be readily apparent from FIGS. 4–5, diverter 74'm cannot properly fit within tube 82". Likewise, diverter 74" cannot properly engage tube 82'. Pairs of diverters 74 and tubes 82 are thus keyed one to another in these embodiments of equipment 10, facilitating such things as identification of components and inventory control should one or the other of a diverter 74 or tube 82 need to be replaced. Yet another example of keying a diverter 74 to a tube 82 is shown in FIG. 6, where wall 170 of diverter 74'" contains one or more external flanges 186 alignable with steps or grooves 190 in tube 82'".

At least some components of equipment 10 may be made of moldable plastics materials such as (but not limited to) urethane, ADS, or acetal. No component need necessarily be made of moldable plastics materials, however, but rather may be formed of any appropriate substance. Additionally, although multiple components of equipment 10 are described in the preceding paragraphs, none need necessarily be utilized exactly as described, and fewer or more components may be used instead. Thus, although the foregoing is provided for purposes of illustrating, explaining, and describing embodiments of the present invention, modifications and adaptations to these embodiments will be apparent to those skilled in the art and may be made without departing from the scope or spirit of the invention.

What is claimed is:

1. A water purification system adapted for use in connection with a conduit having a wall with a hole therein, which conduit admits water flow therethrough, the water purification system comprising:

a. a diverter adapted to be passed through the hole to be positioned within the conduit;

b. water purification media;

c. a container for the water purification media, the container being part of a cartridge;

d. at least one component, comprising a tube having (i) at least a portion circumscribed by the cartridge and (ii) at least one opening through which water may escape, communicating with the diverter to provide a path for water flowing into the diverter so as to allow such water to contact the water purification media;

e. a clamp adapted for attachment to the wall of the conduit and having a riser into which the diverter is fitted; and f. a housing attached to the clamp and surrounding at least a portion of the cartridge.

2. A water purification system according to claim 1 in which the conduit has first and second ends and the diverter comprises a trough adapted to be positioned within the conduit so as to face the first end, thereby receiving in use at least a portion of any water flowing from the first end to the second end of the conduit but not receiving any water flowing from the second end to the first end of the conduit.

3. A water purification system according to claim 2 further comprising a cup formed integrally with the tube, the cup defining at least one opening adapted to communicate at least indirectly with the hole to permit water to flow from the cartridge into the conduit.

4. A water purification system according to claim 3 in which the cartridge is removable, further comprising a retainer forming an end of the container, the retainer defining at least one opening to permit water escaping the tube to enter the container and contact the water purification media.

5. A water purification system according to claim 1 in which the diverter contains at least one feature designed to mate with a corresponding feature of the at least one component with which it communicates, thereby keying the diverter to the at least one component.

6. A water purification system according to claim 5 in which the at least one component comprises a tube and the diverter is selected from a plurality of non-identical diverters so as to have the feature designed to mate with the corresponding feature of the tube.

7. A water purification system according to claim 5 in which the at least one component comprises a tube selected from a plurality of non-identical tubes so as to have a feature designed to correspond to and mate with the feature of the diverter.

8. A water purification system according to claim 1 in which, in use, the container receives pressurized water.

9. A diverter assembly for use in connection with a multi-component fluid purification system comprising a tube having a recess, the diverter assembly comprising:

a. a diverter comprising (i) a trough positionable within a conduit having two ends so as to open toward only one end thereof and (ii) at least one flange designed to mate with the recess of the tube;

b. a fluid flow channel integrally formed with the trough: and c. means for positioning the trough in the conduit.

10. A diverter assembly for use in connection with a multi-component fluid purification system comprising a tube having a recess, the diverter assembly comprising:

a. a diverter comprising (i) a trough positionable within a conduit having two ends so as to open toward only one end thereof and (ii) a semi-circular collar designed to mate with the recess of the tube;

b. a fluid flow channel integrally formed with the trough; and c. means for positioning the trough in the conduit.

11. A diverter assembly for use in connection with a multi-component fluid purification system comprising a tube having a diameter, the diverter assembly comprising:

a. a diverter having a diameter and comprising a trough positionable within a conduit having two ends so as to open toward only one end thereof, the diameter of the diverter being designed to be slightly less than the diameter of the tube so as to allow the diverter to be retained within the tube with a friction fit;

b. a fluid flow channel integrally formed with the trough; and c. means for positioning the trough in the conduit.

12. A method of purifying water flowing through a conduit having a wall with a hole therein, comprising:

a. passing a diverter through the hole into the conduit;

b. receiving a portion of the flowing water into the diverter and thereby diverting the portion of water out of the conduit;

c. exposing the diverted portion of water to purification media; and d. returning the exposed portion of water to the conduit through the hole.

13. A method according to claim 12 further comprising at least indirectly attaching a container for the purification media to the conduit.

14. A method according to claim 12 further comprising creating the hole in the wall of the conduit by removing material therefrom.

* * * * *